US011740575B2

(12) United States Patent
Kodera et al.

(10) Patent No.: US 11,740,575 B2
(45) Date of Patent: Aug. 29, 2023

(54) FIXING DEVICE AND IMAGE FORMING APPARATUS

(71) Applicant: FUJIFILM BUSINESS INNOVATION CORP., Tokyo (JP)

(72) Inventors: Tetsuro Kodera, Ebina (JP); Kosuke Yamada, Ebina (JP); Masato Yamashita, Ebina (JP); Yoshiki Shimodaira, Ebina (JP); Takayuki Yamashita, Ebina (JP); Mitsuhiro Matsumoto, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/529,771

(22) Filed: Nov. 18, 2021

(65) Prior Publication Data

US 2022/0075300 A1 Mar. 10, 2022

Related U.S. Application Data

(63) Continuation of application No. PCT/JP2020/022195, filed on Jun. 4, 2020.

(30) Foreign Application Priority Data

Jul. 10, 2019 (JP) ..... 2019-128458

(51) Int. Cl.
*G03G 15/20* (2006.01)
*G03G 21/20* (2006.01)

(52) U.S. Cl.
CPC ..... *G03G 15/2028* (2013.01); *G03G 21/206* (2013.01)

(58) Field of Classification Search
CPC ..... G03G 15/2028; G03G 21/206
See application file for complete search history.

(56) References Cited

U.S. PATENT DOCUMENTS

2014/0119797 A1 5/2014 Priebe et al.
2016/0070212 A1* 3/2016 Kamoda ..... G03G 15/2021 399/336

FOREIGN PATENT DOCUMENTS

| | | | |
|---|---|---|---|
| JP | S62-264082 | A | 11/1987 |
| JP | 2009-163065 | A | 7/2009 |
| JP | 2009-288491 | A | 12/2009 |
| JP | 2011-039148 | A | 2/2011 |
| JP | 2014-124934 | A | 7/2014 |
| JP | 2019-086612 | A | 6/2019 |

OTHER PUBLICATIONS

JP_2009163065_A_I MachineTranslation. Japan, Takeda, 2009.*
JP_2019086612_A_I MachineTranslation, Japan, Takeuchi, 2019.*
Sep. 8, 2020 International Search Report issued in International Patent Application No. PCT/JP2020/022195.
Sep. 8, 2020 Written Opinion issued in International Patent Application No. PCT/JP2020/022195.

* cited by examiner

*Primary Examiner* — Victor Verbitsky
(74) *Attorney, Agent, or Firm* — Oliff PLC

(57) ABSTRACT

A fixing device includes: a non-contact heating unit configured to heat a recording medium being transported on a transport path in a non-contact manner; a facing member that is disposed along the transport path at a position facing the non-contact heating unit and that is configured to move with respect to the recording medium; and a tension unit configured to tension a facing member in a direction along the transport path.

19 Claims, 10 Drawing Sheets

FIXING DEVICE AND IMAGE FORMING APPARATUS

CROSS-REFERENCE TO RELATED APPLICATIONS

This is a continuation of International Application No. PCT/JP2020/022195 filed on Jun. 4, 2020 and claims priority from Japanese Patent Application No. 2019-128458 filed on Jul. 10, 2019.

BACKGROUND

Technical Field

The present invention relates to a fixing device and an image forming apparatus.

Related Art

JP-A-2009-288491 discloses a fixing device configured to heat and fix a toner image formed on paper, the fixing device including: a heating source configured to heat a gist within a heating region by radiation; a transport part configured to transport the paper to the heating region; and a shielding part provided between the heating source and the heating region and configured to shield radiation from the heating source to the heating region, in which a shielding region where the radiation from the heating source to the heating region is shielded by the shielding part is changed in accordance with a position of the paper transported through the heating region.

SUMMARY

Aspects of non-limiting embodiments of the present disclosure relate to preventing deformation of a facing member in a direction approaching a transport path due to heating, as compared with a fixing device in which a facing member is restrained in a direction along a transport path.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing device including: a non-contact heating unit configured to heat a recording medium being transported on a transport path in a non-contact manner; a facing member that is disposed along the transport path at a position facing the non-contact heating unit and that is configured to move with respect to the recording medium; and a tension unit configured to tension a facing member in a direction along the transport path.

BRIEF DESCRIPTION OF DRAWINGS

Exemplary embodiment(s) of the present invention will be described in detail based on the following figures, wherein.

DETAILED DESCRIPTION

Figure 1:
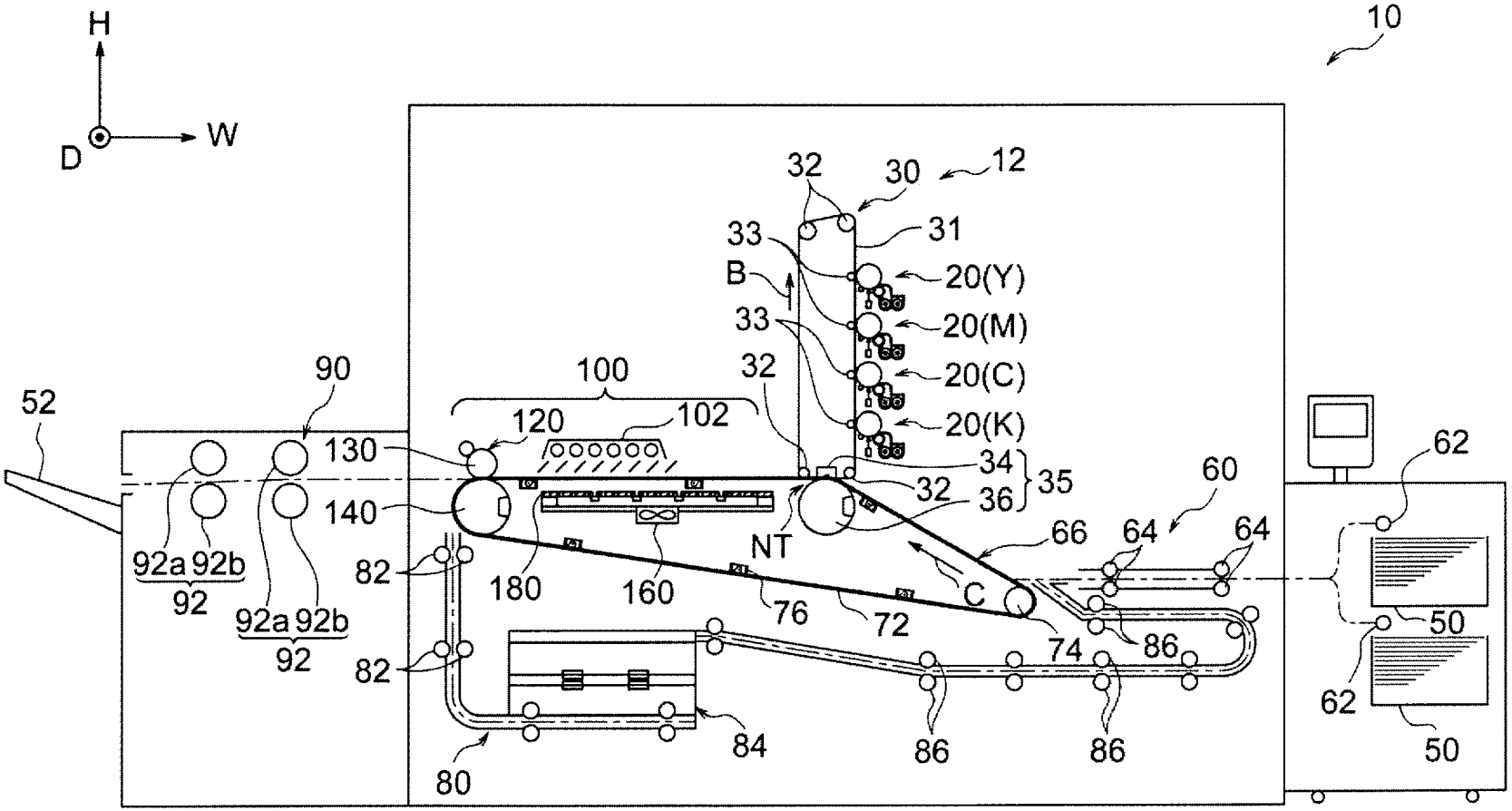
FIG. 1 is a front view showing a schematic configuration of an image forming apparatus according to the present exemplary embodiment.

Examples of a fixing device and an image forming apparatus according to an exemplary embodiment of the present invention will be described with reference to FIGS. 1 to 13. In the drawings, an arrow H indicates an apparatus upper-lower direction (vertical direction), an arrow W indicates an apparatus width direction (horizontal direction), and an arrow D indicates an apparatus depth direction (horizontal direction).

(Image Forming Apparatus 10)

An image forming apparatus 10 according to the present exemplary embodiment is an electrophotographic image forming apparatus that forms and fixes a toner image on a sheet member P as an example of a recording medium. As shown in FIG. 1, the image forming apparatus 10 includes accommodating units 50, a discharge unit 52, an image forming unit 12, a transport mechanism 60, an inverting mechanism 80, a fixing device 100, and a cooling unit 90.

[Accommodating Unit 50]

The accommodating unit 50 has a function of accommodating the sheet member P. In the image forming apparatus 10, plural (for example, two) accommodating units 50 are provided. The plural accommodating units 50 are configured such that the sheet member P is selectively fed from the plural accommodating units 50.

[Discharge Unit 52]

The discharge unit 52 is a portion where the sheet member P on which an image is formed is discharged. Specifically, the discharge unit 52 is configured such that the sheet member P cooled by the cooling unit 90 is discharged to the discharge unit 52 after the image is fixed by the fixing device 100.

[Image Forming Unit 12]

The image forming unit 12 has a function of forming an image on the sheet member P by an electrophotographic method. Specifically, the image forming unit 12 includes toner image forming units 20 that form toner images, and a transfer device 30 that transfers the toner image formed by the toner image forming unit 20 to the sheet member P.

Plural toner image forming units 20 are provided so as to form a toner image for each color. The image forming apparatus 10 includes the toner image forming units 20 of a total of four colors of yellow (Y), magenta (M), cyan (C), and black (K). The (Y), (M), (C), and (K) shown in FIG. 1 indicate constituent portions corresponding to the respective colors.

[Toner Image Forming Unit 20]

Figure 2:
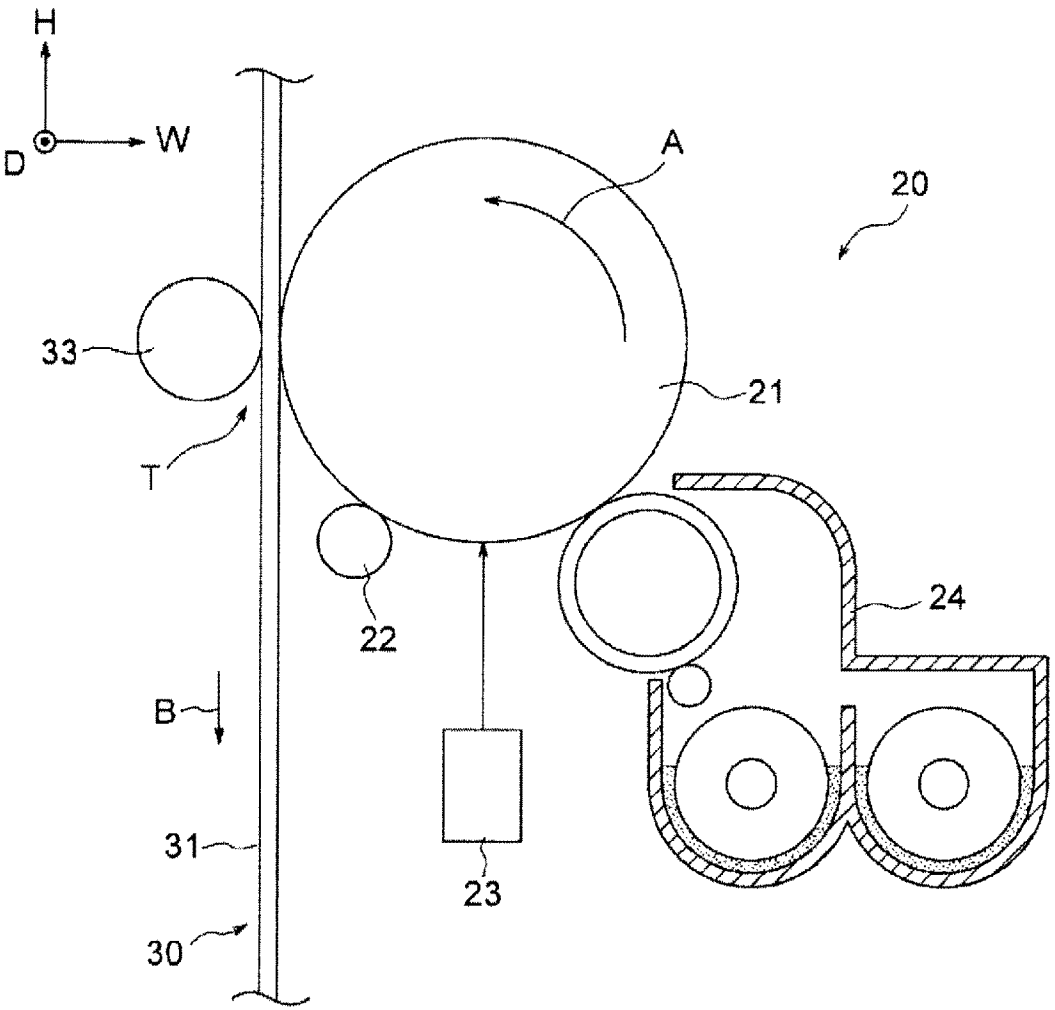
FIG. 2 is a front view showing a schematic configuration of a toner image forming unit according to the present exemplary embodiment.

The toner image forming units 20 of the respective colors are basically configured in a similar manner except for a toner to be used. Specifically, as shown in FIG. 2, the toner image forming unit 20 of each color includes a photoconductor drum 21 that rotates in a direction indicated by an arrow A in FIG. 2, a charger 22 that charges the photoconductor drum 21, an exposure device 23, and a developing device 24. The exposure device 23 exposes the photoconductor drum 21 charged by the charger 22 to form an electrostatic latent image on the photoconductor drum 21. The developing device 24 develops the electrostatic latent image formed on the photoconductor drum 21 by the exposure device 23 by using toner to form a toner image.

(Transfer Device 30)

The transfer device 30 has a function of primarily transferring toner images of the photoconductor drums 21 of the respective colors onto an intermediate transfer body in a superimposed manner, and secondarily transferring the superimposed toner images onto the sheet member P. Specifically, as shown in FIG. 1, the transfer device 30 includes a transfer belt 31 serving as the intermediate transfer body, primary transfer rollers 33, and a transfer unit 35.

The primary transfer roller 33 has a function of transferring the toner image formed on the photoconductor drum 21 to the transfer belt 31 at a primary transfer position T (see FIG. 2) between the photoconductor drum 21 and the primary transfer roller 33.

The transfer belt 31 has an endless shape and is wound around plural rollers 32 to determine a posture thereof. When rotationally driven by at least one of the plural rollers 32, the transfer belt 31 rotates in an arrow B direction, and transports the primarily transferred images to a secondary transfer position NT.

The transfer unit 35 has a function of transferring the toner images transferred to the transfer belt 31 to the sheet member P. Specifically, the transfer unit 35 includes a secondary transfer unit 34 and a facing roller 36.

The facing roller 36 is disposed below the transfer belt 31 so as to face the transfer belt 31. The secondary transfer unit 34 is disposed on an inner side of the transfer belt 31 such that the transfer belt 31 is disposed between the facing roller 36 and the secondary transfer unit 34. The secondary transfer unit 34 is specifically configured with a corotron. In the transfer unit 35, the toner images transferred to the transfer belt 31 are transferred to the sheet member P that passes through the secondary transfer position NT by electrostatic force generated by discharge of the secondary transfer unit 34.

[Transport Mechanism 60]

The transport mechanism 60 has a function of transporting the sheet member P accommodated in the accommodating unit 50 to the secondary transfer position NT. Further, the transport mechanism 60 has a function of transporting the sheet member P transported to the secondary transfer position NT from the secondary transfer position NT to a main heating unit 120 described later.

Specifically, the transport mechanism 60 includes feed rollers 62, plural transport rollers 64, and a chain gripper 66.

The feed roller 62 is a roller that feeds the sheet member P accommodated in the accommodating unit 50. The plural transport rollers 64 are rollers that transport the sheet member P fed by the feed roller 62 to the chain gripper 66. The chain gripper 66 has a function of holding a tip end portion of the sheet member P and transporting the sheet member P. Specifically, the chain gripper 66 includes a pair of chains 72 (see FIG. 4) and grippers 76 (see FIG. 3) serving as holding portions (=gripping portions).

As shown in FIG. 1, the pair of chains 72 are each formed in an annular shape. The pair of chains 72 are arranged at an interval in the apparatus depth direction (see FIG. 4). The pair of chains 72 are respectively wound around a pair of sprockets (not shown) arranged on one end side and the other end side in an axial direction with respect to each of the facing roller 36 and a pressurizing roller 140 described later, and a pair of sprockets 74 arranged at an interval in the apparatus depth direction. When one of the pair of sprockets is rotated, the chain 72 is configured to rotate in an arrow C direction.

The gripper 76 that extends in the apparatus depth direction is stretched across the pair of chains 72. Plural grippers 76 are provided, and are fixed to the pair of chains 72 at predetermined intervals along a circumferential direction (rotation direction) of the chains 72.

The gripper 76 includes a contact member 76B that extends in the apparatus depth direction, and plural claws 76A attached at predetermined intervals along the apparatus depth direction. The gripper 76 is configured to hold the sheet member P by sandwiching the tip end portion of the sheet member P between the plural claws 76A and the contact member 76B.

Then, in the chain gripper 66, the chains 72 are rotated in the arrow C direction in a state where the gripper 76 holds the tip end portion of the sheet member P, so that the sheet member P is transported. The chain gripper 66 shown in FIG. 1 transports the sheet member P transported by the plural transport rollers 64 to the secondary transfer position NT, and then transports the sheet member P to the main heating unit 120 described later after passing the sheet member P through a preliminary heating unit 102 described later. A part of a transport path through which the sheet member P is transported in the transport mechanism 60 is indicated by a one-dot chain line.

In this configuration, the transport mechanism 60 transports the sheet member P in the apparatus width direction such that a sheet surface faces an upper-lower direction at least from the secondary transfer position NT to the main heating unit 120.

[Inverting Mechanism 80]

The inverting mechanism 80 is a mechanism that inverts front and back of the sheet member P. Specifically, as shown in FIG. 1, the inverting mechanism 80 includes plural transport rollers 82, an inverting device 84, and plural transport rollers 86.

The plural transport rollers 82 are rollers that transport the sheet member P fed from the fixing device 100 to the inverting device 84. As an example, the inverting device 84 transports the sheet member P while turning the sheet member P plural times such that a transport direction of the sheet member P changes by, for example, 90 degrees. That is, the inverting device 84 is, for example, a device that twists the sheet member P like a Mobius band to invert the front and back of the sheet member P.

The plural transport rollers 86 are rollers that transport the sheet member P whose front and back have been inverted by the inverting device 84 to the chain gripper 66.

[Fixing Device 100]

The fixing device 100 has a function of fixing the toner image transferred to the sheet member P by the transfer device 30 to the sheet member P. Details of the fixing device 100 will be described later.

[Cooling Unit 90]

The cooling unit 90 has a function of cooling the sheet member P heated by the fixing device 100. As shown in FIG. 1, the cooling unit 90 is disposed downstream of the fixing device 100 in the transport direction of the sheet member P. The sheet member P heated by the fixing device 100 is transported to the cooling unit 90 by a transport roller (not shown). The cooling unit 90 includes two sets of cooling rollers 92 arranged in the apparatus width direction. Since the two sets of cooling rollers 92 have similar configurations, one of the cooling rollers 92 will be described.

As shown in FIG. 1, the cooling roller 92 includes a roller 92*a* disposed on an upper side across the transport path of the sheet member P, and a roller 92*b* disposed on a lower side across the transport path of the sheet member P. The rollers 92*a* and 92*b* are cylindrical aluminum tubes that extend in the apparatus depth direction, and an air blowing mechanism (not shown) generates an air flow inside the rollers 92*a* and 92*b*. Because of the air flow, a temperature of surfaces of the rollers 92*a* and 92*b* is lower than a temperature in a case where the air flow is not generated. In this configuration, rotational force is transmitted from a driving member (not shown) to the roller 92*b* to rotate the roller 92*b*. Further, the roller 92*a* is rotated following the roller 92*b*. Then, the rollers 92*a* and 92*b* transport the sheet member P while sandwiching the sheet member P therebetween, and cool the sheet member P.

(Operation of Image Forming Apparatus)

In the image forming apparatus 10 shown in FIG. 1, an image is formed as follows.

First, in response to a job input from an outside, the accommodating units 50, the discharge unit 52, the image forming unit 12, the transport mechanism 60, the inverting mechanism 80, the fixing device 100, and the cooling unit 90 shift to an operation state.

The charger 22 (see FIG. 2) of each color to which a voltage is applied uniformly negatively charges a surface of the photoconductor drum 21 of each color at a predetermined potential. Subsequently, based on image data of the job input from the outside, the exposure device 23 irradiates the charged surface of the photoconductor drum 21 of each color with exposure light to form an electrostatic latent image.

Accordingly, the electrostatic latent image corresponding to the image data is formed on the surface of each photoconductor drum 21. Further, the developing device 24 of each color develops the electrostatic latent image to visualize the electrostatic latent image as a toner image. Furthermore, the transfer device 30 transfers the toner image formed on the surface of the photoconductor drum 21 of each color to the transfer belt 31.

Therefore, the sheet member P fed from the accommodating unit 50 shown in FIG. 1 to the transport path of the sheet member P by the feed roller 62 and transported by the chain gripper 66 is fed to the secondary transfer position NT where the transfer belt 31 and the facing roller 36 are in contact with each other. At the secondary transfer position NT, the sheet member P is transported while being sandwiched between the transfer belt 31 and the facing roller 36, so that the toner image on a surface of the transfer belt 31 is transferred to an upper side surface PA in the apparatus upper-lower direction, which is a surface of the transported sheet member P.

Further, the fixing device 100 fixes the toner image transferred to the surface of the sheet member P to the sheet member P, and the sheet member P is transported to the cooling unit 90. The cooling unit 90 cools the sheet member P to which the toner image is fixed and discharges the sheet member P to the discharge unit 52.

On the other hand, in a case of forming a toner image on a back surface of the sheet member P, the sheet member P that has passed through the fixing device 100 by being transported by the chain gripper 66 is transported to the transport rollers 82 of the inverting mechanism 80. The sheet member P transported to the transport rollers 82 is transported to the inverting device 84 by the transport rollers 82, and the front and back of the sheet member P are inverted by the inverting device 84. The sheet member P whose front and back have been inverted is transported from the inverting device 84 to the transport rollers 86, and is transported to the chain gripper 66 by the transport rollers 86. The chain gripper 66 transports the sheet member P. Then, in order to form a toner image on the back surface, which is the upper side surface PA in the apparatus upper-lower direction of the sheet member P transported by the inversion, the above-described step is performed again.

(Configurations)

Next, the fixing device 100 will be described.

Figure 3:
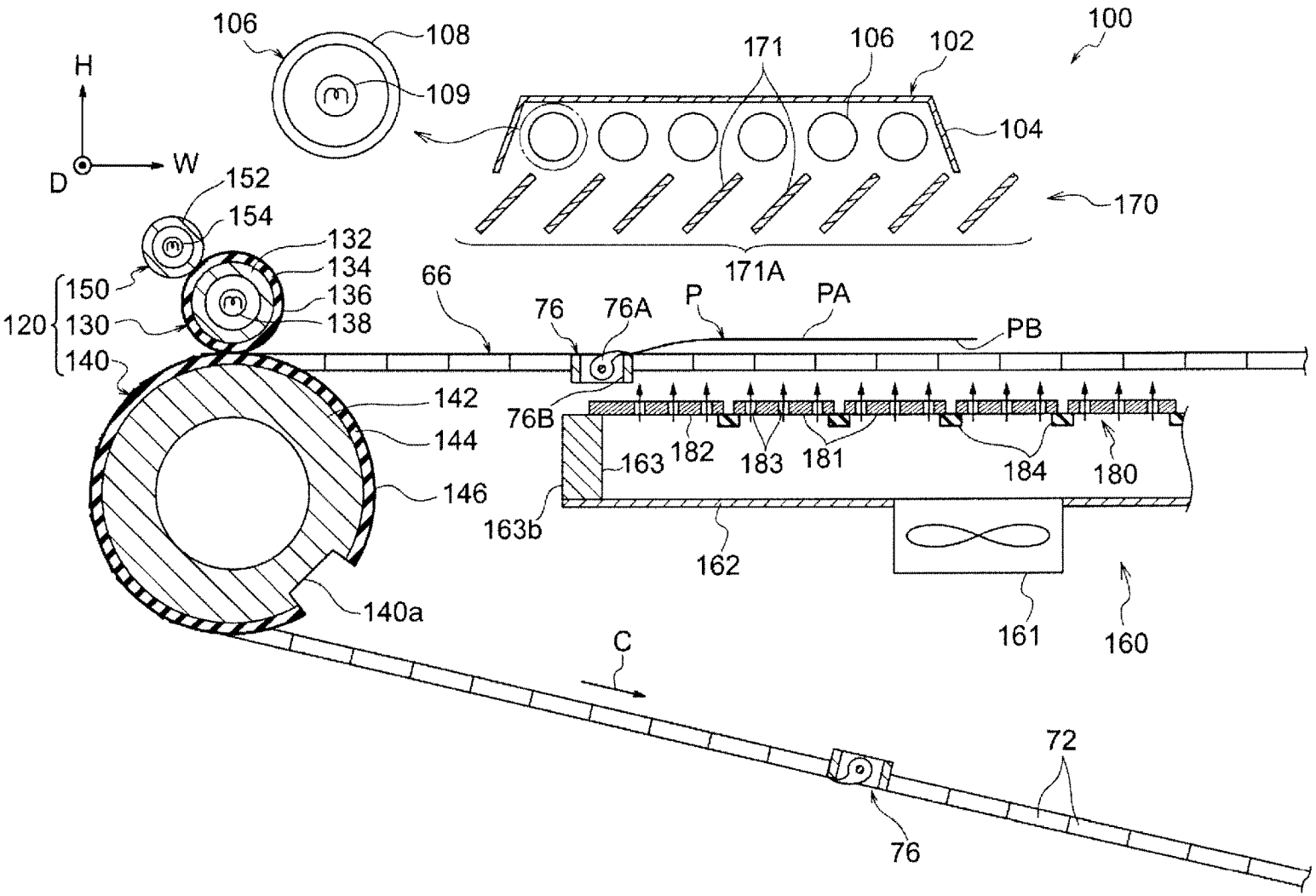
FIG. 3 is a front view showing a schematic configuration of a fixing device according to the present exemplary embodiment.

The fixing device 100 is disposed downstream of the transfer device 30 in the transport direction of the sheet member P. As shown in FIG. 3, the fixing device 100 includes the preliminary heating unit 102 as an example of a non-contact heating unit that heats the sheet member P in a non-contact state with the sheet member P being transported. Further, the fixing device 100 includes the main heating unit 120 that is in contact with the sheet member P to heat and pressurize the sheet member P, a blowing unit 160, a shielding part 170, first tension parts 210, and second tension parts 220. The blowing unit 160 and the shielding part 170 are respectively arranged along the transport path of the sheet member P at predetermined positions facing the preliminary heating unit 102. Constituent elements of the blowing unit 160 and the shielding part 170 do not move from the positions with respect to the transport path. In other words, the blowing unit 160 and the shielding part 170 each move with respect to the sheet member P transported along the transport path. The first tension part 210 and the second tension part 220 are examples of a tension unit.

[Main Heating Unit 120]

As shown in FIG. 3, the main heating unit 120 is disposed downstream of the preliminary heating unit 102 described later in the transport direction of the sheet member P. The main heating unit 120 includes a heating roller 130 that is in contact with the transported sheet member P to heat the sheet member P, a pressurizing roller 140 that pressurizes the sheet member P toward the heating roller 130, and a follower roller 150 that rotates following the rotating heating roller 130.

(Heating Roller 130)

As shown in FIG. 3, the heating roller 130 is disposed so as to be in contact with an upward surface of the transported sheet member P and extend in the apparatus depth direction with an axial direction as the apparatus depth direction.

Further, the heating roller 130 includes a cylindrical base 132, a rubber layer 134 formed so as to cover an entire periphery of the base 132, a release layer 136 formed so as to cover an entire periphery of the rubber layer 134, and a heater 138 accommodated in the base 132. An outer diameter of an outer peripheral surface of the release layer 136 of the heating roller 130 is, for example, 80 [mm].

The base 132 is an aluminum tube and has a thickness of, for example, 20 [mm]. Further, the rubber layer 134 is formed of silicone rubber and has a thickness of, for example, 6 [mm]. Furthermore, the release layer 136 is formed of a copolymer of tetrafluoroethylene and perfluoroethylene (PFA resin), and has a thickness of, for example, 50 [μm].

Shaft portions (not shown) that extend in the apparatus depth direction are respectively formed at both end portions of the heating roller 130 in the apparatus depth direction, and support members (not shown) that respectively support the shaft portions are provided. Accordingly, the heating roller 130 is rotatably supported by the support members at both end portions of the heating roller 130.

(Follower Roller 150)

As shown in FIG. 3, the follower roller 150 is disposed on a side opposite to the sheet member P transported across the heating roller 130 so as to extend in the apparatus depth direction with the axial direction as the apparatus depth direction. Further, the follower roller 150 includes a cylindrical base 152 and a heater 154 accommodated in the base 152. An outer diameter of an outer peripheral surface of the base 152 of the follower roller 150 is, for example, 50 [mm].

The base 152 is an aluminum tube and has a thickness of, for example, 10 [mm]. Then, the follower roller 150 is rotatably supported by support members (not shown) at both end portions of the follower roller 150.

In this configuration, the follower roller 150 is rotated following the heating roller 130. Then, the follower roller 150 heats the heating roller 130. As described above, since the heating roller 130 is heated by the follower roller 150 and the heating roller 130 itself includes the heater 138, a surface temperature of the heating roller 130 has a predetermined value of 180 [° C.] or higher and 200 [° C.] or lower.

(Pressurizing Roller 140)

As shown in FIG. 3, the pressurizing roller 140 is disposed on a side opposite to the heating roller 130 with the transported sheet member P sandwiched therebetween so as to be in contact with a downward surface of the transported sheet member P and extend in the apparatus depth direction with the axial direction as the apparatus depth direction. Further, the pressurizing roller 140 includes a cylindrical base 142, a rubber layer 144 formed so as to cover the base 142, a release layer 146 formed so as to cover the rubber layer 144, and a pair of shaft portions (not shown) formed at both end portions in the apparatus depth direction. An outer diameter of an outer peripheral surface of the release layer 146 of the pressurizing roller 140 is, for example, 225 [mm]. As described above, the outer diameter of the pressurizing roller 140 is larger than the outer diameter of the heating roller.

The base 142 is an aluminum tube and has a thickness of, for example, 20 [mm]. Further, the rubber layer 144 is formed of silicone rubber and has a thickness of, for example, 1 [mm]. Furthermore, the release layer 146 is formed of a copolymer of tetrafluoroethylene and perfluoroethylene (PFA resin), and has a thickness of, for example, 50 [μm].

A recess **140*a* that extends in the apparatus depth direction is formed in an outer peripheral surface of the pressurizing roller 140 (see FIG. 3). When the sheet member P passes between the pressurizing roller 140 and the heating roller 130, the gripper 76 that grips the tip end portion of the sheet member P is accommodated in the recess 140*a* so as not to interfere with the pressurizing roller 140**.

The pressurizing roller 140 is rotated by rotational force transmitted from a driving member (not shown). Then, the heating roller 130 rotates following the rotating pressurizing roller 140, and the follower roller 150 rotates following the rotating heating roller 130. Further, the heating roller 130 and the pressurizing roller 140 sandwich and transport the sheet member P to which the toner image has been transferred, so that the toner image is fixed to the sheet member P.

(Preliminary Heating Unit 102)

The preliminary heating unit 102 is disposed downstream of the secondary transfer position NT where the toner image is transferred to the sheet member P in the transport direction of the sheet member P, and as shown in FIG. 3, above the transported sheet member P (=on a side where the toner image is transferred). The preliminary heating unit 102 includes a reflection plate 104 and plural infrared heaters 106 (hereinafter, referred to as "heaters 106"). The heater 106 is an example of a heat source.

(Reflection Plate 104)

The reflection plate 104 is formed by using an aluminum plate, and is a shallow box-shaped member having an opening on a side of the transported sheet member P. In the present exemplary embodiment, when viewed from above, the reflection plate 104 covers the transported sheet member P in the apparatus depth direction and the apparatus width direction.

(Heater 106)

The heater 106 is a columnar infrared heater that extends in the apparatus depth direction. The plural heaters 106 are arranged side by side at predetermined intervals in the apparatus width direction along the transport path inside the reflection plate 104. In the present exemplary embodiment, when viewed from above, the heaters 106 cover the transported sheet member P in the apparatus depth direction. Further, the heater 106 is away from the transported sheet member P by, for example, 30 [mm] in an upper-lower direction.

The heater 106 emits infrared rays having a maximum spectral radiance at a wavelength of 3 [μm] or more and 5 [μm] or less, and a surface temperature of the heater 106 becomes a predetermined temperature of 300 [° C.] or higher and 1175 [° C.] or lower.

The preliminary heating unit 102 heats the sheet member P, which is transported to a lower side of the preliminary heating unit 102 by the chain gripper 66, from a side of an unfixed toner image transferred to the sheet member P in a non-contact state.

[Shielding Part 170]

As shown in FIG. 3, the shielding part 170 is disposed between the preliminary heating unit 102 and the transported sheet member P. In the present exemplary embodiment, as shown in FIG. 6, the shielding part 170 includes plural shielding members 171 arranged in the apparatus width direction along the transport path, and plural support members 174 that support the shielding members 171.

As shown in FIG. 3, the plural shielding members 171 are arranged between the preliminary heating unit 102 and the transported sheet member P. The shielding member 171 is an example of a facing member that is disposed along the transport path at a position facing the preliminary heating unit 102 in the apparatus upper-lower direction and moves with respect to the transported sheet member P, and is an example of a planar body formed of a rectangular plate material that extends in the apparatus depth direction. The plural shielding members 171 constitute a shielding member group 171A by being arranged in the apparatus width direction along the transport path. The shielding member 171 includes, at both end portions in the apparatus depth direction, cutout portions 172 having U-shaped edges (see FIGS. 6 and 8).

Figure 6:
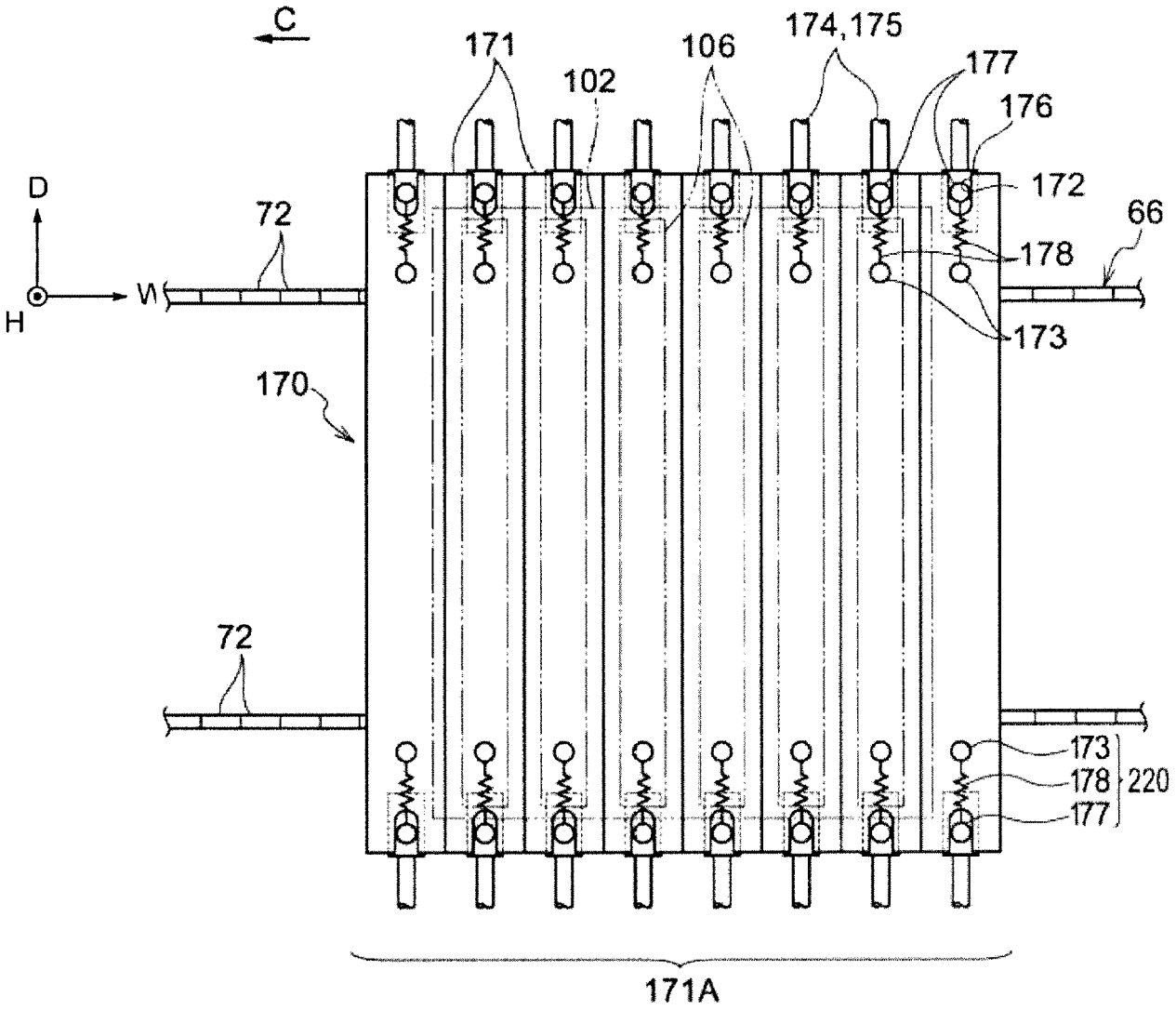
FIG. 6 is a plan view showing a configuration of a shielding part and the tension parts according to the present exemplary embodiment.
Figure 7:
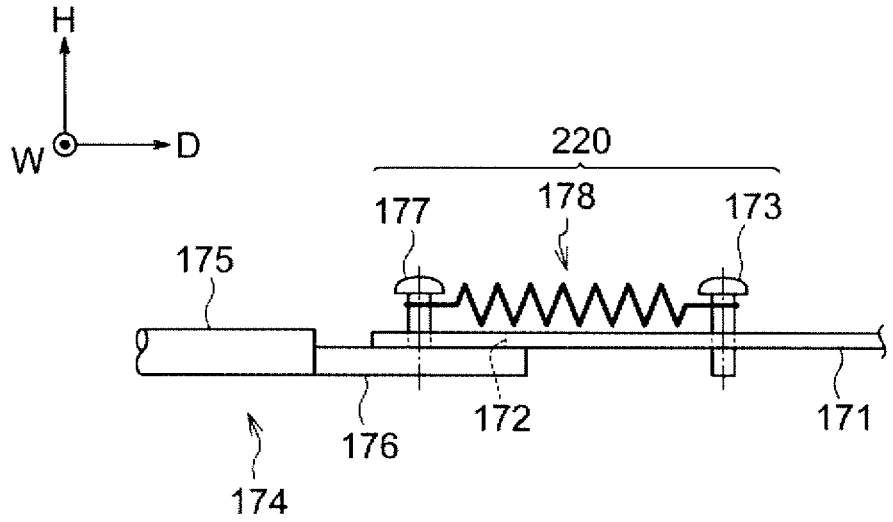
FIG. 7 is an enlarged side view showing parts of the shielding part and the tension part according to the present exemplary embodiment.
Figure 8:
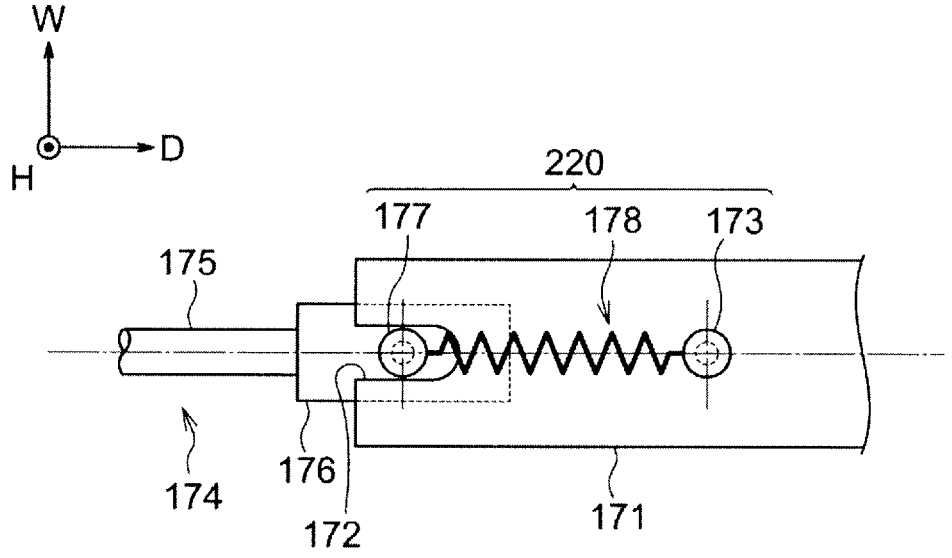
FIG. 8 is an enlarged plan view showing parts of the shielding part and the tension part according to the present exemplary embodiment.

As shown in FIG. 6, the support members 174 are members that are arranged at both end portions of the shielding member 171 in the apparatus depth direction and that extend in the apparatus depth direction. One support member 174 includes a shaft portion 175 that extends in the apparatus depth direction, and a flat plate portion 176 that protrudes in the apparatus depth direction from a tip end of the shaft portion 175.

The flat plate portion 176 has a surface larger than the cutout portion 172 of the shielding member 171, and the shielding member 171 is placed on the surface such that the cutout portion 172 is accommodated. Further, an attachment screw 177, which is an example of an attachment portion that constitutes the second tension part 220 described later, is provided on the flat plate portion 176 so as to protrude from the shielding member 171 through the cutout portion 172. With this configuration, the shielding member 171 is supported so as not to fall in a gravity direction in a state where the shielding member 171 has a degree of freedom in the apparatus depth direction (see FIG. 7). Details of the second tension part 220 will be described later.

In the present exemplary embodiment, an end portion of the shaft portion 175 on a side opposite to the flat plate portion 176 is supported by a case (not shown) of the fixing device 100 via, for example, a bearing so as to be rotatable around the apparatus depth direction. The shaft portion 175 is configured to be rotationally driven by a motor (not shown). Further, the shaft portion 175 is restrained in a translation direction by, for example, a stopper around the bearing.

Figure 9:
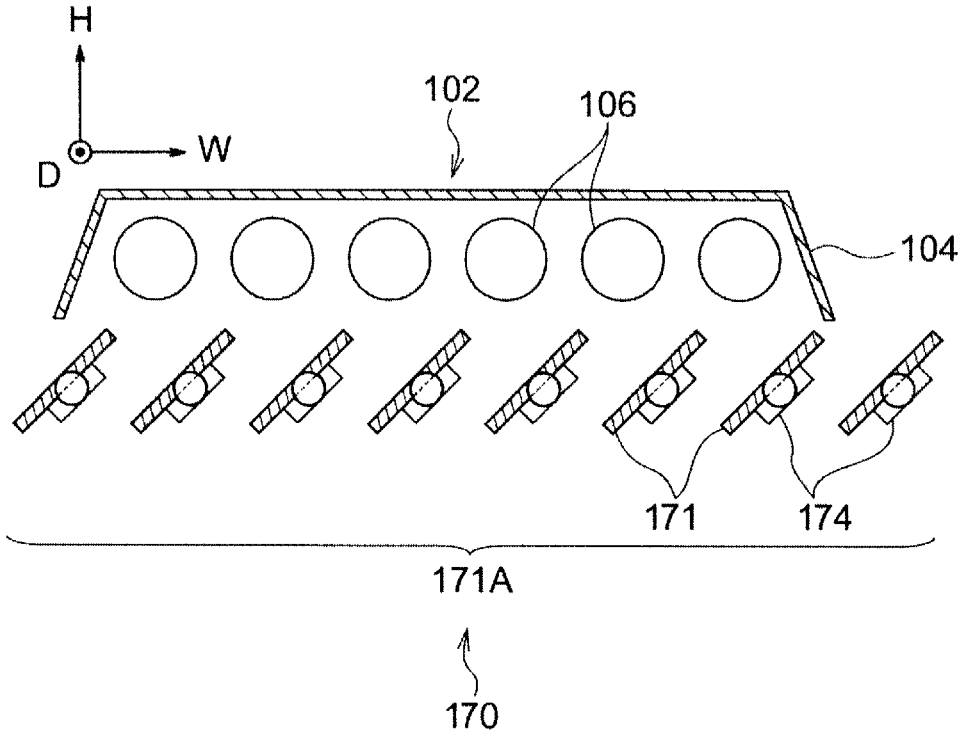
FIG. 9 is a front view showing an open state of shielding members according to the present exemplary embodiment.
Figure 10:
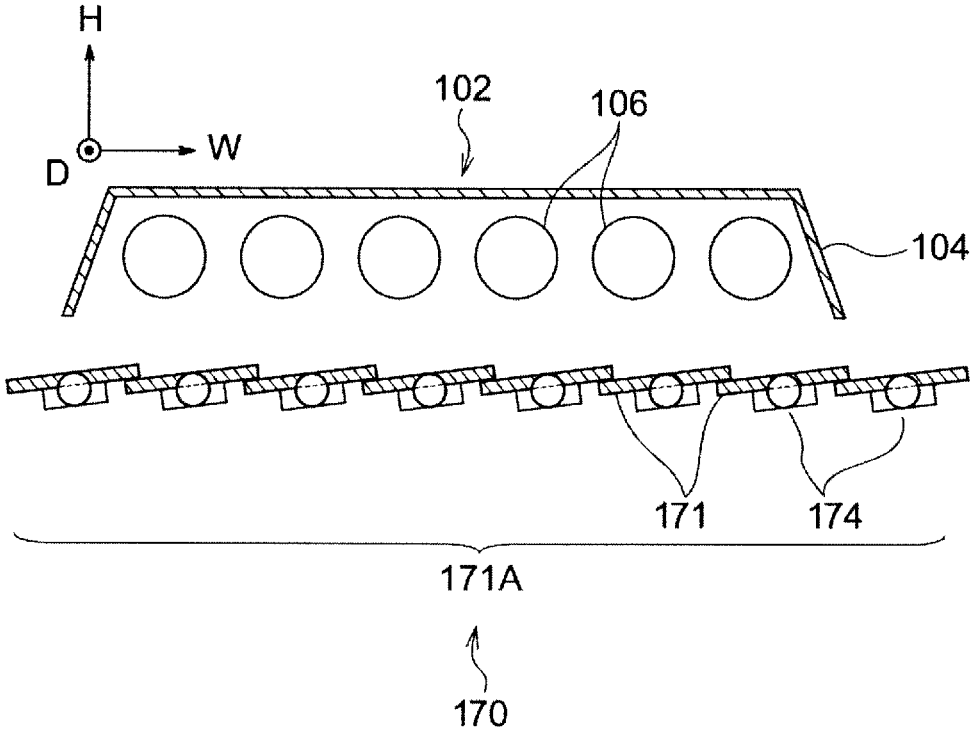
FIG. 10 is a front view showing a shielded state of the shielding members according to the present exemplary embodiment.
Figure 11:
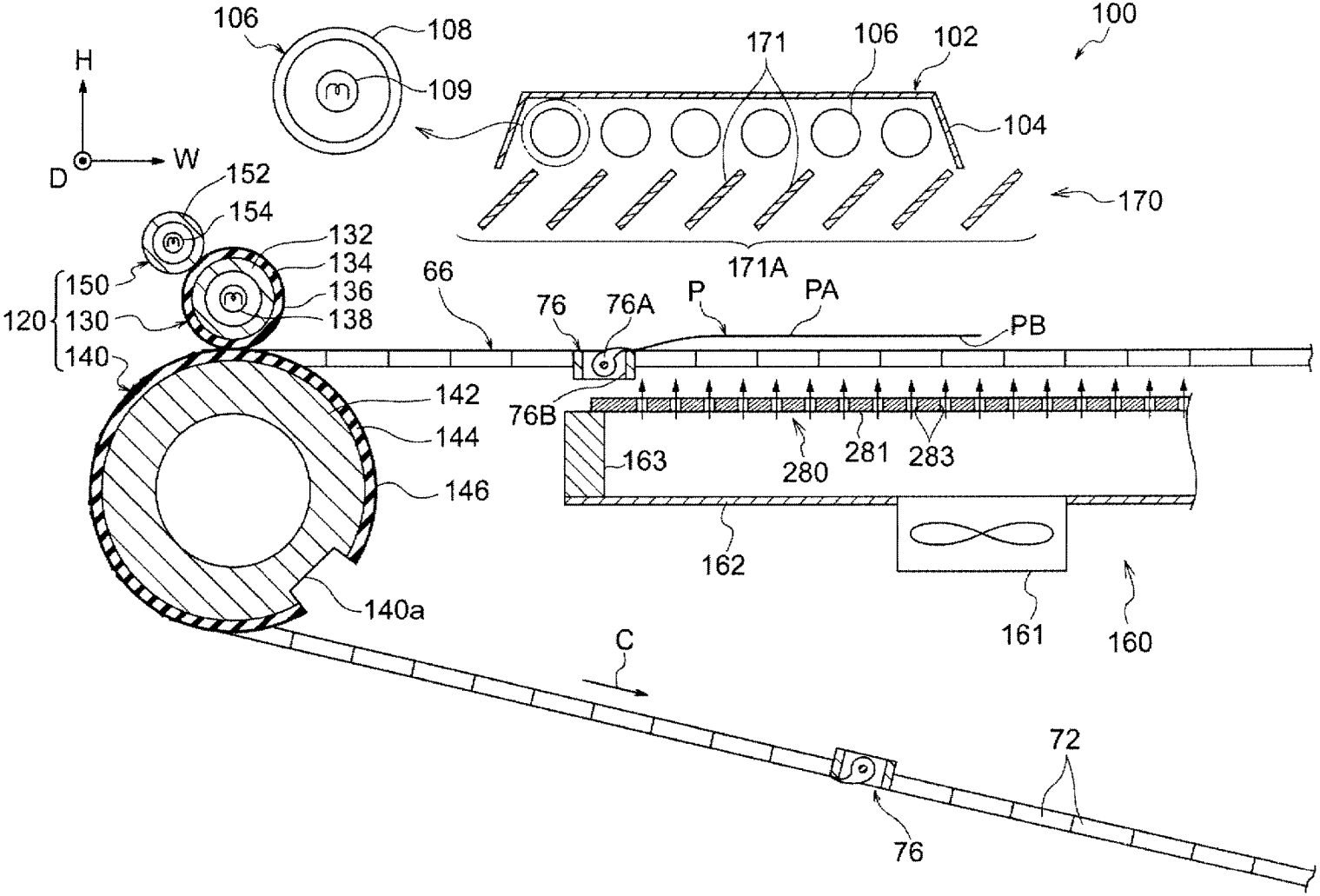
FIG. 11 is a front view showing a modified example of the ventilation plate according to the present exemplary embodiment.
Figure 12:
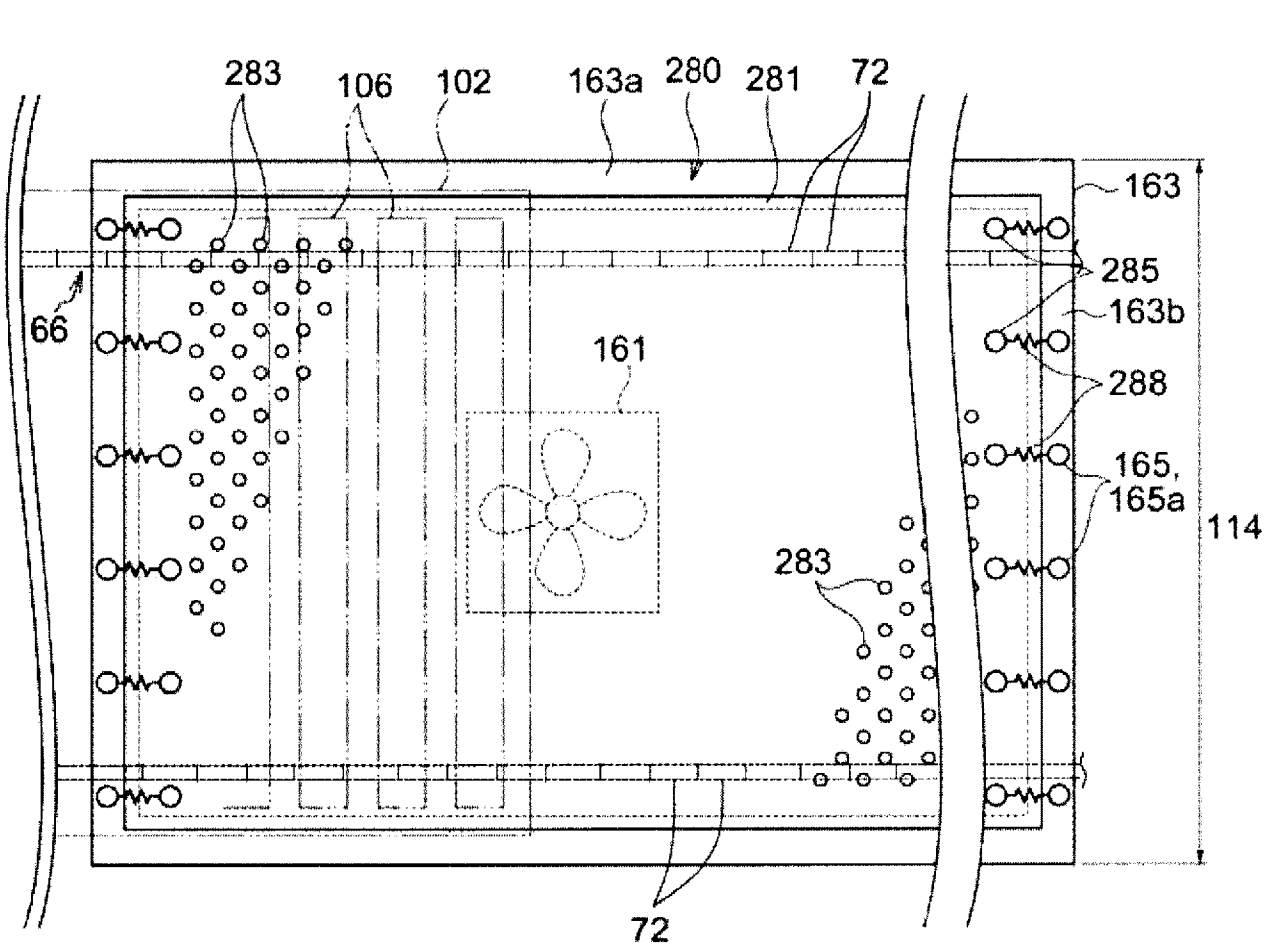
FIG. 12 is a plan view showing a modified example of the ventilation plate and the tension parts shown in FIG. 11.

In this configuration, the plural shielding members 171 may be switched between an open state and a shielded state by the shaft portion 175 being rotated by the motor (not shown). As shown in FIG. 9, the open state in the present exemplary embodiment means a state where, in the plural shielding members 171, a gap open in the apparatus upper-lower direction is formed between the adjacent shielding members. When the plural shielding members 171 are in the open state, the infrared rays emitted from the preliminary heating unit 102 pass through the gaps formed by the plural shielding members 171 and heat the sheet member P transported on the transport path. On the other hand, as shown in FIG. 10, the shielded state in the present exemplary embodiment means a state where, in the plural shielding members 171, the gap between the adjacent shielding members is narrower than that in the open state. When the plural shielding members 171 are in the shielded state, the infrared rays emitted from the preliminary heating unit 102 are shielded by the plural shielding members 171 and are prevented from being emitted below the plural shielding members 171. As shown in FIG. 10, it is desirable that the plural shielding members 171 are in contact with each other so as not to form the gap between the adjacent shielding members, but as long as it is possible to shield the infrared rays emitted from the preliminary heating unit 102 as compared with the open state, the gap may be formed between the adjacent shielding members.

When the fixing device 100 is in the operation state, the plural shielding members 171 are in the open state (see FIG. 9). Then, when the job input to the image forming apparatus 10 is completed, the plural shielding members 171 shift from the open state to the shielded state (see FIG. 10).

(Blowing Unit 160)

Figure 4:
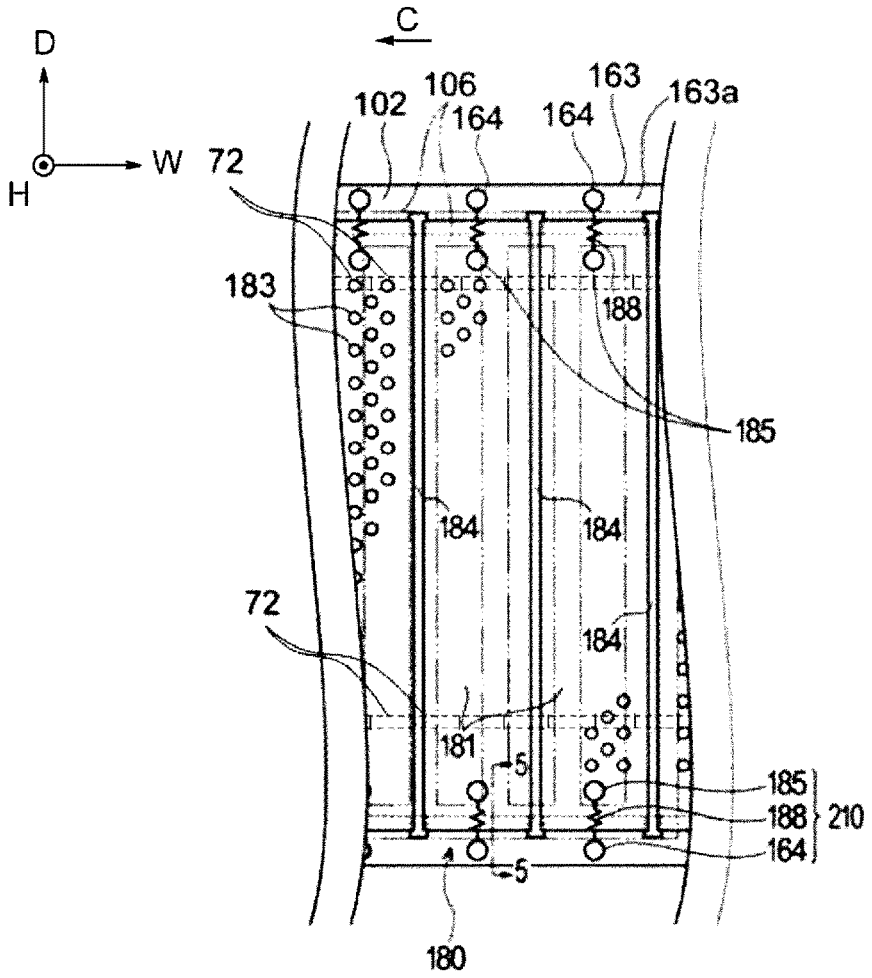
FIG. 4 is a plan view showing a configuration of a ventilation plate and tension parts according to the present exemplary embodiment.
Figure 5:
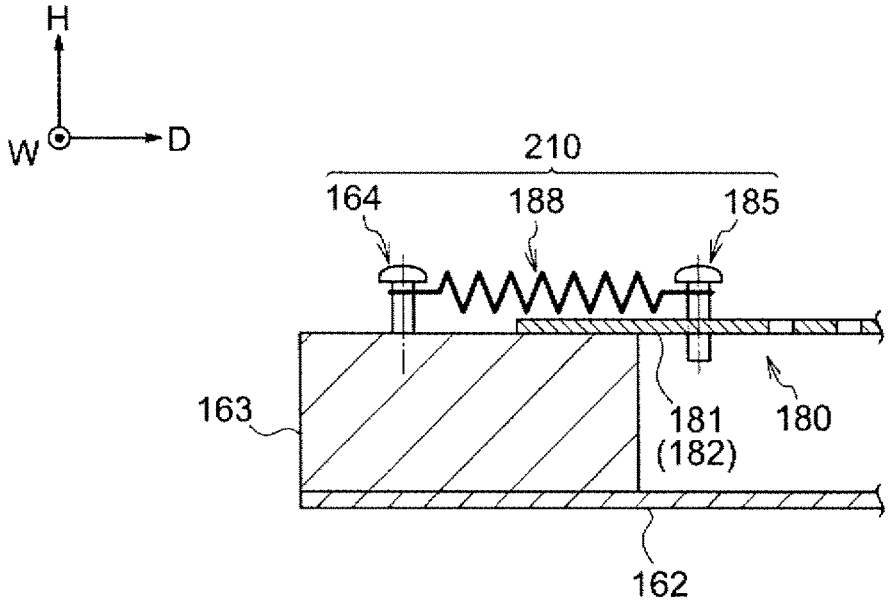
FIG. 5 is a cross-sectional view taken along a line 5-5 of FIG. 4.

As shown in FIG. 3, the blowing unit 160 is disposed in a direction along the transport path at a position facing the preliminary heating unit 102 in the apparatus upper-lower direction. The transported sheet member P passes between the blowing unit 160 and the preliminary heating unit 102. Further, as shown in FIG. 4, the blowing unit 160 includes a fan 161, a bottom plate 162 that is a square plate material, a wall frame 163 that stands on four sides of the bottom plate 162, and a ventilation plate 180. The fan 161 is an example of an air-blowing unit that blows air toward the transport path.

As shown in FIG. 3, the fan 161 and the bottom plate 162 are arranged so as to face the preliminary heating unit 102 in the apparatus upper-lower direction. The bottom plate 162 has an opening that penetrates the bottom plate 162 in a thickness direction at a central portion and is fitted to an outer peripheral portion of the fan 161. The fan 161 is fitted and disposed so as to be embedded in the opening. A periphery of the fan 161 embedded in the opening is in an airtight state.

As shown in FIG. 4, the wall frame 163 includes side wall portions 163*a* that stand on two sides of the bottom plate 162 in the apparatus depth direction, and end wall portions 163*b* (see FIG. 3) that stand on two sides of the bottom plate 162 in the apparatus width direction. With this configuration, the wall frame 163 is formed with an opening in an upper portion of the wall frame 163.

[Ventilation Plate 180]

As shown in FIG. 4, the ventilation plate 180 is an example of a ventilation portion having plural ventilation holes 183 through which air blown from the fan 161 toward a lower side surface PB of the sheet member P passes. The ventilation plate 180 is disposed above the wall frame 163 so as to cover the opening of the wall frame 163 in a state where the ventilation plate 180 has a degree of freedom in the apparatus depth direction and the apparatus width direction with the apparatus upper-lower direction as a thickness direction. Further, the ventilation plate 180 is disposed at a position facing a lower side of the preliminary heating unit 102. The ventilation plate 180 includes two end portion plates 182 arranged at both ends of the ventilation plate 180 in the apparatus width direction along the transport path, and plural plates 181 arranged between the two end portion plates 182 at predetermined intervals in the apparatus width direction along the transport path. Further, the ventilation plate 180 includes plural seal members 184. The plural ventilation holes 183 are formed in the plates 181 and the end portion plates 182.

The plate 181 and the end portion plate 182 are examples of a facing member that is disposed along the transport path at a position facing the preliminary heating unit 102 and moves with respect to the transported sheet member P, and are examples of a planar body formed of a rectangular plate material that extends in the apparatus depth direction. The plates 181 and the end portion plates 182 are arranged at positions facing the lower side of the preliminary heating unit 102, so that the plates 181 and the end portion plates 182 are heated by the preliminary heating unit 102.

The plural ventilation holes 183 penetrate the plates 181 and the end portion plates 182 in the thickness direction. As shown in FIG. 4, the plural ventilation holes 183 are arranged two-dimensionally (in a matrix) along the transport direction of the sheet member P and the apparatus front-rear direction. In FIG. 4, in order to simplify illustration of the ventilation plate 180, some ventilation holes 183 are omitted.

A gap in the apparatus width direction is formed between the end portion plate 182 and the plate 181 adjacent to the end portion plate 182 in the apparatus width direction. Further, gaps in the apparatus width direction are formed among the plates 181 arranged in the apparatus width direction. As shown in FIG. 3, since the plural seal members 184 are arranged in these gaps, the air blown from the fan 161 is prevented from passing through these gaps.

The air blown from the fan 161 passes through the plural ventilation holes 183 arranged two-dimensionally (in the matrix) in the plates 181 and the end portion plates 182, so that the air uniformly hits the lower side surface PB of the sheet member P in the apparatus upper-lower direction. Accordingly, a transport posture of the transported sheet member P is stabilized as compared with a configuration in which the blowing unit 160 is not provided.

Here, "the transport posture of the sheet member P is stabilized" means that a distance from the sheet surface of the sheet member P to the preliminary heating unit 102 is prevented from varying depending on a position of the sheet surface. In other words, a difference between a longest distance from the sheet surface of the sheet member P to the preliminary heating unit 102 and a shortest distance is reduced.

[First Tension Part 210]

The first tension parts 210 are examples of the tension unit that tensions the ventilation plate 180, which is the facing member, in a direction along the transport path. In the present exemplary embodiment, as shown in FIG. 4, the first tension part 210 includes plural pairs of attachment screws 164 and 185 in the blowing unit 160, and plural tension coil springs 188 that respectively connect the pairs of attachment screws 164 and 185. The tension coil spring 188 is an example of a biasing unit that applies tensile force to the ventilation plate 180.

The plural attachment screws 164 are provided on upper portions of the two side wall portions 163*a* at positions that do not interfere with the plates 181 and the end portion plates 182 in a state of being arranged at predetermined intervals in the apparatus width direction so as to be paired with the plates 181 and the end portion plates 182. Specifically, in the blowing unit 160, the attachment screws 164 are arranged for each plate 181 one by one on the upper portions of the side wall portions 163*a* on both sides of one plate 181 in the apparatus depth direction. Further, the attachment screw 164 is disposed at a position where the attachment screw 164 does not interfere with the plate 181 heated and thermally expanded by the preliminary heating unit 102. Further, the attachment screws 164 are also arranged in the same manner on the upper portions of the side wall portions 163*a* on both sides of the end portion plate 182 in the apparatus depth direction.

The attachment screws 185 are provided for each plate 181 one by one at both end portions of the plate 181 in the apparatus depth direction in a state of protruding in the same direction as those of the attachment screws 164. In this configuration, each attachment screw 185 forms a pair with the attachment screw 164 positioned on a side close to each attachment screw 185 among the plural attachment screws 164. The same applies to the end portion plate 182.

In this example, the tension coil spring 188 includes hook portions that is attachable to the attachment screws 164 and 185 at both end portions, and the attachment screw 164 and the attachment screw 185 are connected by these hook portions.

In the present exemplary embodiment, one plate 181 is applied with tensile force in opposite directions by the respective tension coil springs 188 via the attachment screws 185 provided on both end sides in the apparatus depth direction. Further, one plate 181 is stationary in the apparatus depth direction in a state where the plate 181 has a degree of freedom in the apparatus depth direction by balancing the tensile force applied from the respective tension coil springs 188. In other words, each of the plural plates 181 is tensioned in a direction that extends in the apparatus depth direction along the transport path by the plural tension coil springs 188. The same applies to the end portion plate 182.

The "tensioned" state in the exemplary embodiment of the present invention indicates a state where a plate-shaped object having a degree of freedom in a direction along at least one surface is stationary in a state where tensile force is applied in at least one direction of the degree of freedom. In the present exemplary embodiment, the number of degrees of freedom may be two or four. In the present exemplary embodiment, the plate 181 and the end portion plate 182 have degrees of freedom in four directions on both sides in the apparatus depth direction and both sides in the apparatus width direction, and tensile force is applied in two directions on both sides in the apparatus depth direction. Further, in the present exemplary embodiment, the shielding member 171 has degrees of freedom in two directions on both sides in the apparatus depth direction, and tensile force is applied to the shielding member 171 in two directions on both sides in the apparatus depth direction.

[Second Tension Part]

The second tension parts 220 are examples of the tension unit that tensions the shielding member 171, which is the facing member, in a direction along the transport path. In the present exemplary embodiment, as shown in FIG. 6, the second tension part 220 includes plural pairs of attachment screws 173 and 177 in the shielding part 170, and plural tension coil springs 178 that respectively connect the pairs of attachment screws 173 and 177. The tension coil spring 178 is an example of a biasing unit that applies tensile force to the shielding member 171.

The attachment screws 177 are provided one by one on the flat plate portions 176 of the support members 174 provided on both sides of the shielding member 171 in the apparatus depth direction in a state of protruding from the shielding member 171 through the respective cutout portions 172. The plural attachment screws 177 are arranged at positions that do not interfere with the edges of the cutout portions 172 of the shielding members 171 thermally expanded by heating by the preliminary heating unit 102.

The attachment screws 173 are provided for each shielding member 171 one by one at positions on both end sides of the shielding member 171 in the apparatus depth direction and on inner sides with respect to the cutout portions 172 in the apparatus depth direction in a state of protruding in the same direction as those of the attachment screws 177. In this configuration, each attachment screw 173 forms a pair with the attachment screw 177 positioned on a side close to each attachment screw 173 among the plural attachment screws 177.

In the present exemplary embodiment, the tension coil spring 178 includes hook portions that is attachable to the attachment screws 173 and 177 at both end portions, and the attachment screw 173 and the attachment screw 177 are connected by these hook portions.

In the present exemplary embodiment, one shielding member 171 is applied with tensile force in opposite directions by the respective tension coil springs 178 via the attachment screws 173 provided on both end sides in the apparatus depth direction. Further, one shielding member 171 is stationary in the apparatus depth direction in a state where the shielding member 171 has a degree of freedom in the apparatus depth direction by balancing the tensile force applied from the respective tension coil springs 178. In other words, each of the plural shielding members 171 is tensioned by the plural tension coil springs 178 in a direction that extends in the apparatus depth direction along the transport path.

(Operation)

Next, an operation of the present exemplary embodiment will be described. In the following description, the present exemplary embodiment will be compared with a comparative embodiment shown below. In the comparative embodiment, when components and the like used in the image forming apparatus 10 according to the present exemplary embodiment are used, reference numerals and names of the components and the like are used as they are.

Comparative Embodiment

A fixing device of the comparative embodiment (hereinafter, referred to as "comparative device") does not include the first tension parts 210 and the second tension parts 220. Specifically, both end portions of the plate 181 and the end portion plate 182 in an apparatus depth direction of the ventilation plate 180 of the comparative device are fastened onto the wall frame 163 by, for example, screws, and are attached in a state of being restrained in the apparatus depth direction and an apparatus width direction. Further, both end portions of the shielding member 171 in the apparatus depth direction of the shielding part 170 of the comparative device are fastened to the flat plate portions 176 of the support members 174 by, for example, screws, and are attached in a state of being restrained in the apparatus depth direction and the apparatus width direction.

Except for the above points, the comparative device is configured in the same manner as the fixing device 100 of the present exemplary embodiment.

When the preliminary heating unit 102, which is a non-contact heating unit, heats the transported sheet member P, infrared rays are emitted from the heater 106. The infrared rays emitted from the heater 106 heat the transported sheet member P, and heat the plates 181, the end portion plates 182, and the shielding members 171 arranged at positions facing the preliminary heating unit 102. The plate 181, the end portion plate 182, and the shielding member 171 are thermally expanded by being heated.

In the comparative device, when the plate 181, the end portion plate 182, and the shielding member 171 that are facing members are thermally expanded, both end portions in the apparatus depth direction are restrained. Therefore, the plate 181, the end portion plate 182, and the shielding member 171 are bent and deformed in a direction approaching a transport path when viewed from a transport direction of the transported sheet member P. Specifically, the plate 181 and the end portion plate 182 are in a state where both end portions in the apparatus depth direction are restrained on the wall frame 163, upper side surfaces are heated by the heater 106, and air is blown from the fan 161 disposed on a lower side. The air blown from the fan 161 passes through the ventilation holes 183 and cools lower side surfaces of the plate 181 and the end portion plate 182. In this state, when the plate 181 and the end portion plate 182 are thermally expanded and deformed, the plate 181 and the end portion plate 182 are bent and deformed upward in an apparatus upper-lower direction. Then, when the shielding member 171 is thermally expanded and deformed in a state where both end portions in the apparatus depth direction are restrained, the shielding member 171 is bent and deformed downward in the apparatus upper-lower direction due to an action of gravity.

In the comparative device, when the plate 181 and the end portion plate 182 of the ventilation plate 180 are bent and deformed in a direction approaching the transport path, the plate 181 and the end portion plate 182 may interfere with the lower side surface PB of the transported sheet member P. Accordingly, a posture of the sheet member P transported above the ventilation plate 180 may vary. Further, when the transported sheet member P is inverted by the inverting mechanism 80, a toner image transferred at the secondary transfer position NT is formed on the lower side surface PB before being inverted by the inverting mechanism 80. Therefore, when the deformed plate 181 and the deformed end portion plate 182 interfere with the toner image formed on the lower side surface PB of the sheet member P inverted by the inverting mechanism 80, an image defect of the image formed on the lower side surface PB may occur.

In the comparative device, when the plate 181 and the end portion plate 182 are bent and deformed in a direction approaching the transport path, a two-dimensional property (matrix property) of arrangement of the plural ventilation holes 183 formed in the plate 181 and the end portion plate 182 is impaired. Since the two-dimensional property (matrix property) of the plural ventilation holes 183 is impaired, the air that is blown from the fan 161 and passes through the plural ventilation holes 183 unevenly hits the lower side surface PB of the sheet member P, and the posture of the sheet member P transported above the ventilation plate 180 may vary.

In the comparative device, when the shielding member 171 of the shielding part 170 is bent and deformed in a direction approaching the transport path, the shielding member 171 may interfere with the upper side surface PA of the transported sheet member P. Accordingly, the posture of the transported sheet member P may vary. Further, the toner image transferred at the secondary transfer position NT is formed on the upper side surface PA of the transported sheet member P. Therefore, when the deformed shielding member 171 interferes with the upper side surface PA of the transported sheet member P, an image defect of the image formed on the upper side surface PA may occur.

On the other hand, the plate 181 and the end portion plate 182 of the present embodiment are tensioned in the apparatus depth direction along the transport path by the first tension parts 210 in a state where the plate 181 and the end portion plate 182 have degrees of freedom in the apparatus depth direction. In this state, when the plate 181 and the end portion plate 182 are thermally expanded and deformed, the plate 181 and the end portion plate 182 are deformed in a direction in which the plate 181 and the end portion plate 182 extend in the apparatus depth direction that is a tension direction, and deformation of bending in a direction approaching the transport path is prevented. Therefore, in the fixing device 100 according to the present exemplary embodiment, the variation in the posture of the transported sheet member P due to the bending of the plate 181, the end portion plate 182, and the shielding member 171 is prevented as compared with the comparative device. Therefore, in the image forming apparatus 10 according to the present exemplary embodiment, the image defect of the image formed on the sheet member P is prevented as compared with the image forming apparatus including the comparative device.

Since the plate 181 and the end portion plate 182 are plate materials that extend in the apparatus depth direction along the transport path, an elongation amount due to thermal expansion in the apparatus depth direction, which is a longitudinal direction, is larger than an elongation amount due to thermal expansion in the apparatus width direction, which is a lateral direction. In the present exemplary embodiment, the first tension parts 210 tension the plate 181 and the end portion plate 182 in the apparatus depth direction that is the longitudinal direction, so that deformation in a direction in which the plate 181 and the end portion plate 182 extend in the longitudinal direction is facilitated, and deformation of bending in a direction approaching the transport path is prevented. Therefore, in the present exemplary embodiment, deformation of the plate 181 and the end portion plate 182 in a direction approaching the transport path is prevented as compared with a configuration (second configuration) in which the first tension parts 210 tension the plate 181 and the end portion plate 182 in a direction intersecting the longitudinal direction. The same applies to the second tension part 220 and the shielding member 171. The second configuration described above is included in technical ideas of the present invention as a modified example of the present exemplary embodiment.

In the present exemplary embodiment, the ventilation plate 180 extends in the apparatus depth direction intersecting the transport direction of the transported sheet member P, and includes the plural plates 181 and the plural end portion plates 182 arranged side by side in the apparatus width direction along the transport direction. In other words, the ventilation plate 180 has a configuration divided into the plural plates 181 and the plural end portion plates 182. Therefore, a diagonal length of one plate 181 or one end portion plate 182 is shorter than a diagonal length of the ventilation plate 180 in a configuration (third configuration) in which the ventilation plate 180 is a single plate material that is not divided. Therefore, in the present exemplary embodiment, a deformation amount of bending of each plate 181 and a deformation amount of bending of each end portion plate 182 due to the thermal expansion are smaller than a deformation amount of bending of the third configuration. In other words, in the present exemplary embodiment, deformation of the ventilation plate 180 in a direction approaching the transport path is prevented as compared with the configuration in which the ventilation plate 180 is a single plate material having a size equivalent to an overall size of the plural plates 181 and the two end portion plates 182. The same applies to the shielding member group 171A and the shielding member 171. The third configuration described above is included in the technical ideas of the present invention as a modified example of the present exemplary embodiment (see FIGS. 11 and 12).

In the present exemplary embodiment, the preliminary heating unit 102 extends in the apparatus depth direction that is a direction along the transport direction of the transported sheet member P, and includes the plural heaters 106 arranged at predetermined intervals in the apparatus width direction intersecting the apparatus depth direction. Therefore, deformation amounts of the plate 181 and the end portion plate 182 in a direction approaching the transport path by the preliminary heating unit 102 are larger in the apparatus depth direction, which is a longitudinal direction of the heater 106, than in the apparatus width direction in which the plural heaters 106 are arranged at the predetermined intervals. In the present exemplary embodiment, the first tension parts 210 tension the plate 181 and the end portion plate 182 in the apparatus depth direction that is the longitudinal direction of the heater 106, so that deformation in a direction in which the plate 181 and the end portion plate 182 extend in the longitudinal direction is facilitated, and deformation in a direction approaching the transport path is prevented. Therefore, in the present exemplary embodiment, deformation of the plate 181 and the end portion plate 182 in a direction approaching the transport path is prevented as compared with a configuration (fourth configuration) in which the first tension parts 210 tension the plate 181 and the end portion plate 182 in a direction intersecting the longitudinal direction of the heater 106. The same applies to the second tension part 220 and the shielding member 171. The fourth configuration described above is included in the technical idea of the present invention as a modified example of the present exemplary embodiment.

In the present exemplary embodiment, the plural heaters 106 extend in the apparatus depth direction intersecting the transport direction of the transported sheet member P, and the plural heaters 106 are arranged in the apparatus width direction intersecting the apparatus depth direction at the predetermined intervals. Therefore, in the present exemplary embodiment, the transported sheet member P is transported in the apparatus width direction while being uniformly heated in the apparatus depth direction intersecting the transport direction by the plural heaters 106. On the other hand, in a configuration (fifth configuration) in which the plural heaters 106 extend in the apparatus width direction that is a transport direction, and the plural heaters 106 are arranged in the apparatus depth direction at predetermined intervals, heating spots corresponding to intervals of the plural heaters 106 occur in the apparatus depth direction intersecting the transport direction on a transport path. Therefore, in the present exemplary embodiment, as compared with the fifth configuration, heating spots in a direction intersecting the transport direction on the transported sheet member P are prevented. The fifth configuration described above is included in the technical idea of the present invention as a modified example of the present exemplary embodiment.

Although a specific embodiment of the present invention has been described in detail above, the present invention is not limited to the above-described exemplary embodiment, and various modifications, changes, and improvements may be made within the scope of the technical idea of the present invention.

For example, in the present exemplary embodiment, the plate 181 and the end portion plate 182 having degrees of freedom in the apparatus depth direction are tensioned by the first tension parts 210 provided on both sides in the apparatus depth direction. However, as a modified example of the present exemplary embodiment, a configuration may be adopted in which, in a state where one end portions of the plate 181 and the end portion plate 182 in an apparatus depth direction are restrained in the apparatus depth direction, the other end portions are tensioned by applying tensile force thereto by the first tension parts 210. The same applies to the shielding member 171 and the second tension part 220.

In the present exemplary embodiment, in the first tension part 210, the tension coil spring 188 is used as an example of the biasing unit to apply tensile force to the plate 181 and the end portion plate 182. However, the biasing unit is not limited to the tension coil spring 188. For example, a configuration may be adopted in which a wire having a weight attached to one end thereof and a fixed pulley provided on the side wall portion 163*a* are used, and tensile force due to gravity of the weight converted in a horizontal direction by the fixed pulley is applied to the plate 181 and the end portion plate 182. The same applies to the shielding member 171 and the second tension part 220.

In the present exemplary embodiment, the plate 181 and the end portion plate 182 that extend in the apparatus depth direction are tensioned in the apparatus depth direction. However, the plate 181 and the end portion plate 182 may be configured to be tensioned in the apparatus width direction orthogonal to the apparatus depth direction, or may be configured to be tensioned from two directions of the apparatus depth direction and the apparatus width direction. The same applies to the shielding member 171 and the second tension part 220.

Figure 13:
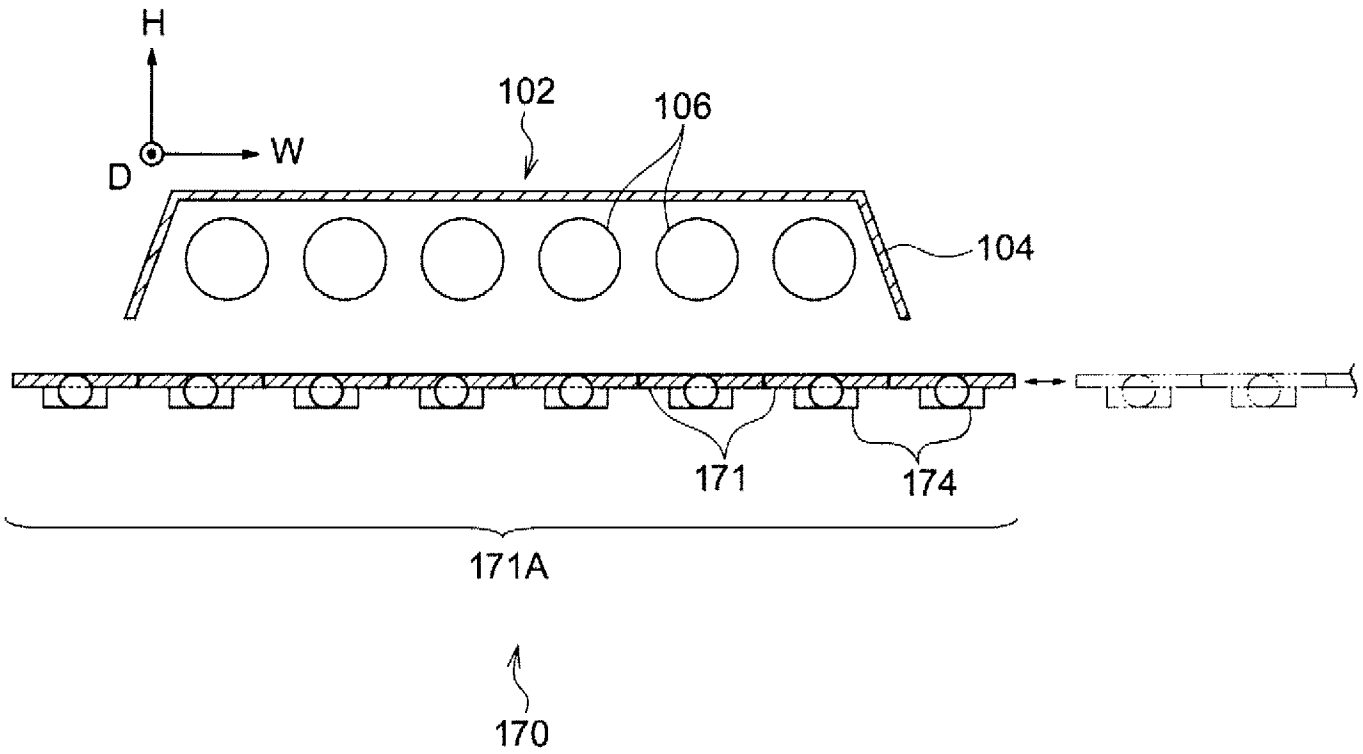
FIG. 13 is a front view showing a modified example of the shielding part according to the present exemplary embodiment.

In the present exemplary embodiment, the shielding part 170 is configured to switch between the open state and the shielded state with respect to the preliminary heating unit 102 by rotating the plural shielding members 171 around the respective shaft portions 175. However, the shielding part 170 is not limited to the configuration in which the plural shielding members 171 are rotated around the respective shaft portions 175. For example, as shown in FIG. 13, the shielding part 170 may be configured such that the plural shielding members 171 that extend in an apparatus depth direction slide in an apparatus width direction in a state where the plural shielding members 171 are densely arranged in the apparatus width direction with plate surfaces facing a direction along a transport path. In the configuration shown in FIG. 13, the shaft portion 175 is supported by a rail (not shown) attached to a case (not shown) of the fixing device 100 in a state where the shaft portion 175 has a degree of freedom in the apparatus width direction. As for the configuration in which the plural shielding members 171 slide, the shielding members 171 not supported by the shaft portions 175 may be supported by rails attached to the case of the fixing device 100 in a state where the shielding members 171 each have degrees of freedom in the apparatus width direction. Further, the shielding part 170 may be configured such that one plate material that shields the preliminary heating unit 102 slides in the apparatus width direction on a rail attached to the case of the fixing device 100.

In the present exemplary embodiment, the ventilation plate 180 has a configuration in which the plural plates 181 and the plural end portion plates 182 that extend in the apparatus depth direction are arranged in the apparatus width direction. However, the ventilation plate 180 may have a configuration in which the plural plates 181 and the plural end portion plates 182 that extend in the apparatus width direction are arranged in the apparatus depth direction. The same applies to the shielding part 170 and the shielding member 171.

In the present exemplary embodiment, the tension coil spring 188 is attached to the attachment screw 164 provided on the wall frame 163. However, an object to which the tension coil spring 188 is attached is not limited to the attachment screw 164. For example, a protrusion formed integrally with the wall frame 163 may be adopted. The same applies to the attachment screws 185 for the plate 181 and the end portion plate 182, the attachment screw 177 for the support member 174, and the attachment screw 173 for the shielding member 171.

In the present exemplary embodiment, the transport path of the fixing device 100 extends in the apparatus width direction. However, the transport path of the fixing device 100 is not limited to a transport path that extends in the apparatus width direction. For example, the transport path of the fixing device 100 may extend in the apparatus width direction and extend upward in the apparatus upper-lower direction.

In the present exemplary embodiment, the plates 181 and the end portion plates 182 of the ventilation plate 180, and the shielding members 171 of the shielding part 170 are the facing members that are arranged along the transport path at the positions facing the preliminary heating unit 102 and move with respect to the transported sheet member P. However, the facing members are not limited thereto. For example, the facing member may be a guide plate disposed along the transport path on a lower side of the transport path in order to contact and support an end portion such that the end portion of the sheet member P transported by the chain gripper 66 on a side opposite to a side held by the gripper 76 is positioned at a predetermined height.

In the present exemplary embodiment, the fixing device 100 includes the shielding part 170. However, the fixing device 100 may not include the shielding part 170.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a heater configured to heat a recording medium being transported on a transport path in a non-contact manner;

a ventilation plate that is along the transport path at a position facing the heater and that is configured to move with respect to the recording medium; and a tensioner configured to tension the ventilation plate in a direction along the transport path, wherein air is blown through a ventilation hole in the ventilation plate to the recording medium, and the ventilation plate is on a side opposite to the heater with respect to the transport path.

2. A fixing device comprising:

a heater configured to heat a recording medium being transported on a transport path in a non-contact manner;

a plurality of planar bodies along the transport path at a position facing the heater and that is configured to move with respect to the recording medium; and a tensioner configured to tension the plurality of planar bodies in a direction along the transport path, wherein the plurality of planar bodies extend in a direction intersecting a transport direction of the recording medium, the plurality of planar bodies are arranged side by side in the transport direction, and the tensioner tensions the plurality of planar bodies in a longitudinal direction of the planar bodies.

3. The fixing device according to claim 1, wherein the ventilation plate extends in one direction along the transport path, and the tensioner tensions the ventilation late in a longitudinal direction of the ventilation plate.

4. The fixing device according to claim 2, wherein the ventilation plate extends in one direction along the transport path, and the tensioner tensions the facing member in a longitudinal direction of the facing member.

5. The fixing device according to claim 3, wherein the ventilation plate includes a plurality of planar bodies extending in a direction intersecting a transport direction of the recording medium, the plurality of planar bodies being arranged side by side in the transport direction, and the tensioner tensions the plurality of planar bodies in a longitudinal direction of the planar bodies.

6. The fixing device according to claim 1, wherein the heater includes a plurality of heat sources, the plurality of heat sources are arranged side by side in a direction intersecting a longitudinal direction of the heat sources and extend in one direction along the transport path, and the tensioner tensions the ventilation plate in a longitudinal direction of the heat sources.

7. The fixing device according to claim 4, wherein the heater includes a plurality of heat sources, the plurality of heat sources are arranged side by side in a direction intersecting a longitudinal direction of the heat sources and extend in one direction along the transport path, and the tensioner tensions the plurality of planar bodies in a longitudinal direction of the heat sources.

8. The fixing device according to claim 3, wherein the heater includes a plurality of heat sources, the plurality of heat sources are arranged side by side in a direction intersecting a longitudinal direction of the heat sources and extend in one direction along the transport path, and the tensioner tensions the ventilation plate in a longitudinal direction of the heat sources.

9. The fixing device according to claim 2, wherein the heater includes a plurality of heat sources, the plurality of heat sources are arranged side by side in a direction intersecting a longitudinal direction of the heat sources and extend in one direction along the transport path, and the tensioner tensions the plurality of planar bodies in a longitudinal direction of the heat sources.

10. The fixing device according to claim 5, wherein the heater includes a plurality of heat sources, the plurality of heat sources are arranged side by side in a direction intersecting a longitudinal direction of the heat sources and extend in one direction along the transport path, and the tensioner tensions the ventilation plate in a longitudinal direction of the heat sources.

11. The fixing device according to claim 6, wherein the plurality of heat sources extend in a direction intersecting a transport direction of the recording medium.

12. The fixing device according to claim 7, wherein the plurality of heat sources extend in a direction intersecting a transport direction of the recording medium.

13. The fixing device according to claim 8, wherein the plurality of heat sources extend in a direction intersecting a transport direction of the recording medium.

14. The fixing device according to claim 9, wherein the plurality of heat sources extend in a direction intersecting the transport direction.

15. The fixing device according to claim 10, wherein the plurality of heat sources extend in a direction intersecting the transport direction.

16. An image forming apparatus comprising:

an image forming unit configured to form an image on a recording medium being transported; and the fixing device according to claim 1, the fixing device being downstream of the image forming unit in a transport direction of the recording medium, and including a contact fixing unit downstream of the heater in the transport direction and the ventilation plate on a side of a surface on which an image is formed by the image forming unit with respect to the transport path.

17. An image forming apparatus comprising:

an image forming unit configured to form an image on a recording medium being transported;

an inverting mechanism configured to invert front and back of a recording medium having an image formed on one surface and to transport the recording medium to the image forming unit; and a fixing device according to claim 1, the fixing device being downstream of the image forming unit in a transport direction of the recording medium and upstream of the inverting mechanism in the transport direction, and including a contact fixing unit downstream of the heater in the transport direction and the ventilation plate on a side opposite to a surface on which an image is formed by the image forming unit with respect to the transport path.

18. An image forming apparatus comprising:

an image forming unit configured to form an image on a recording medium being transported; and the fixing device according to claim 2, the fixing device being downstream of the image forming unit in a transport direction of the recording medium, and including a contact fixing unit downstream of the heater in the transport direction and the plurality of planar bodies on a side of a surface on which an image is formed by the image forming unit with respect to the transport path.

19. An image forming apparatus comprising:

an image forming unit configured to form an image on a recording medium being transported;

an inverting mechanism configured to invert front and back of a recording medium having an image formed on one surface and to transport the recording medium to the image forming unit; and a fixing device according to claim 2, the fixing device being downstream of the image forming unit in a transport direction of the recording medium and upstream of the inverting mechanism in the transport direction, and including a contact fixing unit downstream of the heater in the transport direction and the plurality of planar bodies on a side opposite to a surface on which an image is formed by the image forming unit with respect to the transport path.

* * * * *